US010301772B2

(12) United States Patent
Lunsford et al.

(10) Patent No.: US 10,301,772 B2
(45) Date of Patent: May 28, 2019

(54) CARPETS WITH SURFACTANT-STABILIZED EMULSION POLYMER CARPET BINDERS FOR IMPROVED PROCESSABILITY

(75) Inventors: David J. Lunsford, Fountain Inn, SC (US); Rajeev Farwaha, Belle Mead, NJ (US); Joerg Ludwig Schulte, Frankfurt am Main (DE); Kerstin Gohr, Hochheim (DE)

(73) Assignee: CELANESE INTERNATIONAL CORPORATION, Irving, TX (US)

( * ) Notice: Subject to any disclaimer, the term of this patent is extended or adjusted under 35 U.S.C. 154(b) by 940 days.

(21) Appl. No.: 13/695,851

(22) PCT Filed: May 3, 2011

(86) PCT No.: PCT/US2011/034964

§ 371 (c)(1),
(2), (4) Date: Jan. 17, 2013

(87) PCT Pub. No.: WO2011/140065

PCT Pub. Date: Nov. 10, 2011

(65) Prior Publication Data

US 2013/0149487 A1 Jun. 13, 2013

(30) Foreign Application Priority Data

May 3, 2010 (WO) ..... PCT/US2010/033377

(51) Int. Cl.
*D06N 7/00* (2006.01)

(52) U.S. Cl.
CPC ..... *D06N 7/0063* (2013.01); *D06N 7/0071* (2013.01); *D06N 7/0073* (2013.01); *D06N 2203/042* (2013.01); *D06N 2203/045* (2013.01); *D06N 2205/023* (2013.01); *Y10T 428/23986* (2015.04); *Y10T 428/23993* (2015.04)

(58) Field of Classification Search
CPC ..... D06N 7/0071; D06N 7/0073; D06N 2203/042; D06N 2203/045; D06N 2205/02; D06N 2205/023
USPC ..... 428/97, 95
See application file for complete search history.

(56) References Cited

U.S. PATENT DOCUMENTS 3,729,438 A * 4/1973 Plesich et al. ..... C08F 8/00 524/806
4,097,436 A * 6/1978 Buning ..... C04B 41/4988 428/429
4,239,563 A * 12/1980 Iacoviello ..... C09J 123/08 156/72
4,735,986 A 4/1988 Iacoviello
4,959,249 A * 9/1990 Schilling ..... D06M 15/227 427/387
5,026,765 A 6/1991 Katz et al.
5,849,389 A 12/1998 Lunsford et al.
5,889,098 A 3/1999 Trumbo
6,028,139 A * 2/2000 Farwaha ..... C09D 131/04 524/715
6,174,960 B1 * 1/2001 Phan ..... C09D 131/04 427/387
6,359,076 B1 3/2002 Lunsford et al.
7,649,067 B2 * 1/2010 Zecha ..... C08F 218/18 526/287
8,039,563 B2 * 10/2011 Weitzel ..... C08F 2/20 524/459
8,053,511 B2 * 11/2011 Muller ..... C08F 2/24 524/556

(Continued)

FOREIGN PATENT DOCUMENTS

EP 0564712 B1 10/1993
EP 0864685 A2 9/1998

(Continued)

OTHER PUBLICATIONS

Extended European Search Report issued in a corresponding EP13174314.8 dated Aug. 5, 2013. International Search Report issued in a corresponding PCT/US2011/034964.

* cited by examiner

*Primary Examiner* — Cheryl Juska
(74) *Attorney, Agent, or Firm* — Roberts Mlotkowski Safran Cole & Calderon, P.C.

(57) ABSTRACT

Disclosed are improved carpet products made using certain types of coating compositions to secure carpet fibers to a carpet backing or substrates and/or to secure one or more carpet scrims or other layers to carpet backing. The coating compositions, which can be in the form of either precoating or skip coating compositions, are made from latex binder emulsions based on interpolymers emulsion polymerized from vinyl esters, ethylene, and a multifunctional cross-linking co-monomer such as an unsaturated silane. Such emulsions are also stabilized with surfactant emulsifiers but are substantially free of protective colloid stabilizers. The multifunctional co-monomer alters interpolymer molecular weight, branching and/or flow properties such that films formed from such interpolymers exhibit relatively low elongation values. When the emulsion binder exhibits such non-elongating film-forming characteristics, the carpet coating composition made from such binders can be easily processed without build-up on carpet processing apparatus. Such binder emulsions which are stabilized substantially only with surfactant emulsifiers, and not with protective colloids, also have excellent compatibility with other coating composition components.

19 Claims, No Drawings

(56) References Cited

U.S. PATENT DOCUMENTS 9,090,793 B2 * 7/2015 Ratering ..... C09D 133/10
9,382,341 B2 * 7/2016 Sagl ..... D06N 7/0073
9,624,622 B2 * 4/2017 Muller ..... D06N 7/0063
2005/0032970 A1 * 2/2005 Jakob ..... C08F 8/30 524/556
2005/0287336 A1 6/2005 Lunsford et al.
2007/0088120 A1 * 4/2007 Zecha ..... C08F 218/18 524/832
2007/0112117 A1 * 5/2007 Weitzel ..... C08F 2/20 524/459
2007/0184732 A1 * 8/2007 Lunsford ..... C09D 131/04 442/59
2008/0039572 A1 * 2/2008 Mueller ..... C08F 218/08 524/457
2009/0203832 A1 * 8/2009 Muller ..... C08F 2/24 524/557
2010/0056696 A1 * 3/2010 Poole ..... C09D 131/04 524/501
2012/0009379 A1 * 1/2012 Muller ..... C08F 218/08 428/96
2012/0021237 A1 * 1/2012 Confalone ..... D21H 19/56 428/514
2013/0156997 A1 * 6/2013 Muller ..... D06N 7/0063 428/87
2013/0177733 A1 * 7/2013 Muller ..... D06N 3/0006 428/95
2013/0209726 A1 * 8/2013 Lunsford ..... C09J 131/02 428/95
2014/0018473 A1 * 1/2014 Ratering ..... C09D 133/12 523/437
2014/0087120 A1 * 3/2014 Sagl ..... D06N 7/0073 428/96
2014/0162018 A1 * 6/2014 Lunsford ..... D06N 7/0073 428/96
2014/0316096 A1 * 10/2014 Berbee ..... C08F 210/16 526/352.2
2015/0086746 A1 * 3/2015 B.R. de Castro .... D06N 7/0063 428/96
2015/0125649 A1 * 5/2015 Lunsford ..... C09D 131/04 428/97
2015/0322279 A9 * 11/2015 Lunsford ..... C09D 131/04 428/97
2017/0253759 A1 * 9/2017 Kunstle ..... C09J 131/04
2017/0321375 A1 * 11/2017 Melchin ..... C09D 7/61
2018/0135242 A1 * 5/2018 Melchin ..... C09J 131/04

FOREIGN PATENT DOCUMENTS

EP 1008689 A2 6/2000
EP 2088162 A1 * 8/2009 ..... C08F 2/24
WO WO-2010089142 A1 * 8/2010 ..... C08F 218/08
WO WO-2012007356 A1 * 1/2012 ..... B01J 19/1862
WO WO 2014036740 A1 * 3/2014 ..... C08F 2/22

CARPETS WITH SURFACTANT-STABILIZED EMULSION POLYMER CARPET BINDERS FOR IMPROVED PROCESSABILITY

FIELD OF THE INVENTION

The present invention relates to the use in carpet products of carpet coating compositions which contain an essentially all surfactant-stabilized vinyl ester/ethylene-based emulsion binder and which provide improved processability for carpet substrates coated therewith.

BACKGROUND OF THE INVENTION

Most conventional carpets comprise a primary backing with yarn tufts in the form of cut or uncut loops extending upwardly from this backing to form a pile surface. For tufted carpets, the yarn is inserted into a primary backing (frequently a woven or nonwoven material) by tufting needles and a pre-coat (i.e., a binder) is applied thereto.

Most residential and commercial carpets are also manufactured with a woven scrim (typically made from polypropylene) attached to the back of the carpet to provide dimensional stability to the carpet. The scrim is attached to the pre-coated carpet back with another binder formulation typically referred to as a skip coat or adhesive coating. The skip coat is applied to the scrim, and the scrim is then applied to the pre-coated backing of the carpet before the assembled carpet elements are sent into a curing oven. The purpose of the skip coat or adhesive coating is to provide a layer of material which will adhere the woven scrim to the back of the carpet.

For both the pre-coat and the skip coat, the physical properties of the binder are important to their successful utilization as carpet coatings. In this regard, there are a number of important requirements which must be met by such coatings. The coating must be capable of being applied to the carpet and dried using the processes and equipment conventionally employed in the carpet industry for latex, e.g. emulsion, coating. The binder composition must provide excellent adhesion to the pile fibers to secure them firmly in the backing. The coating will also typically have a high loading of fillers such as calcium carbonate, clay, aluminum trihydrate, barite, feldspar, cullet, flyash and/or recycled carpet backing.

The binders in coating compositions for carpet materials are frequently emulsion polymers, i.e., latex compositions, which can comprise copolymers of vinyl esters (such as vinyl acetate) and ethylene. Carpet coating compositions based on vinyl ester/ethylene copolymers are disclosed, for example, in U.S. Pat. Nos. 4,735,986; 5,026,765; 5,849,389 and 6,359,076 and in U.S. Patent Application Publication No. 2005/0287336. These copolymers are prepared by polymerizing appropriate co-monomers in an aqueous emulsion. Such emulsions can be stabilized by adding conventional surfactants (anionic, nonionic, cationic) as emuslifiers. Such emulsions may also be stabilized by including protective colloids such as those based on polyvinyl alcohols (PVOH), ionically modified starches, water-soluble starches, starch ethers, polyacrylic acid, carboxymethyl cellulose, natural gums, gelatin, synthetic polymers, or water-soluble cellulose ethers such as hydroxyethyl cellulose (HEC).

Substantially all-surfactant-based vinyl ester/ethylene (VAE) latex emulsions (i.e., those containing very little or no protective colloid as emulsion stabilizers) are especially desirable from the standpoint of permitting effective compounding of the emulsion with the various types of filler materials which are used in carpet coating compositions. Substantially all-surfactant stabilized binder emulsions also provide excellent compatibility with other materials typically used by the carpet industry in carpet manufacture such as styrene-butadiene rubber (SBR) emulsions.

Notwithstanding such filler compounding and compatibilty benefits, substantially all-surfactant-based vinyl ester/ethylene emulsions, when serving as carpet coating compositions, can lead to some processing problems during carpet manufacture. In particular, such processing problems can manifest themselves when the carpet containing the all-surfactant binder emulsion exits the curing oven at 110° C.-120° C. and then travels over a series of guide rollers and possibly through a shearing machine. Substantially all-surfactant stabilized coating compositions have a tendency to transfer to the rollers and create build-up which can cause maintenance issues. In addition, at times this build-up can transfer back to the carpet which can cause gouges in the face of the carpet as it goes through the shearing machine.

Attempts have been made to retain the benefits of substantially all-surfactant-based latex binders while minimizing the processing problems hereibefore described. Such attempts, for example, have involved the use of vinyl ester-ethylene based emulsions stabilized with both surfactant emulsifiers and protective colloids such as PVOH. While some of such attempts have been somewhat successful, these mixed emulsifier/colloid systems must be very precisely formulated and even then still have a tendency not to provide all of the benefits which could be realized by the use of either type of stabilizer system alone. Accordingly, there continues to be a need to identify carpet coating compositions based on vinyl ester/ethylene copolymer emulsions which exhibit all the benefits of substantially all-surfactant stabilized emulsions but which do not result in an unacceptable incidence of adverse processing problems during carpet manufacture.

SUMMARY OF THE INVENTION

The present invention is directed to improved carpet products which employ a certain type of coating compositions in their manufacture. Such carpet coating compositions are those which, upon drying, can secure carpet fibers to a carpet backing or substrate, and/or can adhesively secure one or more carpet scrims or other layers to the back of the carpet.

In one aspect of the present invention, the coating composition used in the manufacture of the carpet product comprises: A) an interpolymer present in an amount effective to function as a binder in the carpet coating composition; B) water; and C) a stabilizing system which comprises one or more anionic and/or nonionic surfactants and which is present in an amount which is effective to disperse the interpolymer in the water. The interpolymer in this composition is prepared by the emulsion polymerization of: i) one or more vinyl ester monomers; ii) ethylene; and iii) an unsaturated, multi-functional cross-linking silane co-monomer (or equivalent non-silicon, unsaturated multi-functional cross-linking co-monomer) which is effective to alter interpolymer molecular weight, branching and/or flow properties such that a film formed from this interpolymer exhibits an elongation value (as defined hereinafter) of less than about 125% at 110° C. The surfactant stabilizing system in this composition must also be substantially free of any protective colloid material.

In another aspect of the present invention, the aqueous coating composition used in the manufacture of the carpet product comprises the same types of interpolymer and surfactant-based emulsion stabilizing system as just described. In this embodiment, the interpolymer is prepared by polymerizing from about 67.0 to 94.9 pphm of a vinyl acetate monomer; from about 1.0 to 30.0 pphm of ethylene, and from about 0.1 to 3.0 pphm of an unsaturated silane co-monomer (or alternatively from about 0.1 to 4.0 pphm of an unsaturated, multifunctional co-monomer selected from diacetone acrylamide and acetoacetoxy ethyl methacrylate, and 0.1 to 3.0 pphm of an adipic acid dihydrazide water-soluble, cross-linking agent).

Carpet products which utilize carpet coating compositions of the foregoing types are easily processed without undesirable amounts of the coating composition building up on processing apparatus. The coating compositions used in such carpet products also provide excellent compatibility with the carpet filler materials and other carpet components such as SBR materials.

DETAILED DESCRIPTION OF THE INVENTION

The coating compositions incorporated into the improved carpet products of the present invention will essentially contain as a binder an interpolymer formed by the emulsion polymerization of vinyl ester monomers, ethylene, and a an unsaturated silane co-monomer. This emulsion polymerization can be carried out in conventional manner to form a binder latex containing the desired interpolymer.

The vinyl esters utilized in the formation of the interpolymer of the latex emulsion are the esters of alkanoic acids, the acid having from one to about 13 carbon atoms. Typical examples include; vinyl formate, vinyl acetate, vinyl propionate, vinyl butyrate, vinyl isobutyrate, vinyl valerate, vinyl-2-ethyl-hexanoate, vinyl isooctanoate, vinyl nonate, vinyl decanoate, vinyl pivalate, vinyl versatate, etc. Of the foregoing, vinyl acetate is the preferred monomer because of its ready availability and low cost.

The vinyl ester is present in the interpolymer in amounts ranging from about 67.0 pphm to 94.9 pphm (parts per hundred based on total monomers in the interpolymer). More preferably, the vinyl ester content of the interpolyer used in the carpet coating compositions herein will range from about 70 pphm to 90 pphm.

The second major component of the interpolymer formed in the binder latex is ethylene. Ethylene will generally comprise from about 1.0 pphm to 30.0 pphm. More preferably, ethylene will be present in the interpolymer in amounts ranging from about 2 pphm to 25 pphm.

The third component of the interpolymer in the binder latex comprises a minor amount of an unsaturated silane co-monomer. This co-monomer can generally correspond to a substituted silane of the structural Formula I:

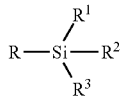

in which R denotes an organic radical olefinically unsaturated in the ω-position and $R^1$, $R^2$ and $R^3$ which may be identical or different, denote halogen, preferably chlorine, or the group —OZ, Z denoting hydrogen or primary or secondary alkyl or acyl radicals optionally substituted by alkoxy groups.

Suitable unsaturated silane compounds of the Formula I are preferably those in which the radical R in the formula represents an ω-unsaturated alkenyl of 2 to 10 carbon atoms, particularly of 2 to 4 carbon atoms, or an ω-unsaturated carboxylic acid ester formed from unsaturated carboxylic acids of up to 4 carbon atoms and alcohols carrying the Si group of up to 6 carbon atoms. Suitable radicals $R^1$, $R^2$, $R^3$ are preferably the group —OZ, Z representing primary and/or secondary alkyl radicals of up to 10 carbon atoms, preferably up to 4 carbon atoms, or alkyl radicals substituted by alkoxy groups, preferably of up to 3 carbon atoms, or acyl radicals of up to 6 carbon atoms, preferably of up to 3 carbon atoms, or hydrogen. Most preferred unsaturated silane co-monomers are vinyl trialkoxy silanes.

Examples of preferred silane compounds of the Formula I include vinyltrichlorosilane, vinylmethyldichlorosilane, γ-methacryloxypropyltris(2-methoxyethoxy)silane, vinylmethoxysilane, vinyltrimethoxysilane, vinyltriethoxysilane, vinyldiethoxysilanol, vinylethoxysilanediol, allyltriethoxysilane, vinyltripropoxysilane, vinyltriisopropoxysilane, vinyltributoxysilane, vinyltriacetoxysilane, trimethylglycolvinylsilane, γ-methacryloxypropyltrimethylglycolsilane, γ-acryloxypropyltriethoxysilane and γ-methacryloxypropyltrimethoxysilane.

The unsaturated silane co-monomer as described above is selected and used in forming the interpolymer of the coating compositions used herein in amounts which are effective to alter interpolymer molecular weight, branching and/or flow properties in a certain manner. In particular, such interpolymer properties should be altered by the unsaturated silane co-monomer such that a film formed from the interpolymer exhibits selected elongation values in the Film Elongation Test as described hereinafter in the Test Methods section. (For purposes of this invention, the term "altered" means changed from the properties which would be exhibited by the same type of VAE interpolymer prepared without the silane co-monomer incorporated therein.)

It has been found that when the interpolymer is cast into a test film, and when that test film exhibits elongation values of 125% or less in the Film Elongation Test at 110° C., then carpet products utilizing a coating composition comprising such an interpolymer, along with the other composition components described herein, can be processed with an acceptably low incidence of processing problems. This means that the binder in a coating composition based on such an interpolymer will not transfer to any unacceptable extent to processing rollers as carpet passes therethrough. Accordingly, binder build-up on rollers as well as potential transfer back problems can be minimized or avoided. Even more preferably, the interpolymer used in the carpet coating compositions employed in the carpet products herein should exhibit elongation values of less than 100%, and even more preferably from 5% to 50%, in the Film Elongation Test.

Interpolymers having the requisite effect on test film elongation properties are generally those made using from about 0.1 pphm to 3.0 pphm of the unsaturated silane co-monomer, along with the aforementioned amounts of vinyl ester and ethylene co-monomers. More preferably, the amount of unsaturated silane co-monomer used to form the interpolymer will range from about 0.2 pphm to 1.0 pphm.

It may also be possible to prepare interpolymers for use in the carpet coating compositions herein which utilize non-silicon-containing co-monomers to achieve the requisite low film elongation characteristics for films made from such interpolymers. Such non-silicon-containing co-monomers could be, for example, any unsaturated, multi-functional, cross-linking co-monomers which, when incorporated into the interpolymer in appropriate amounts, provide interpolymers which exhibit elongation values of less than 125%, or preferably less than 100%, or even more preferably from 5% to 50%, in the Film Elongation Test.

Suitable non-silicon-containing unsaturated multi-functional co-monomers can include, for example, unsaturated compounds which contain one or more carbonyl moieties. Preferred co-monomers of this type include those having two or more carbonyl moieties. Examples of such suitable co-monomers include diacetone acrylamide (DiAAA), polymerizable 1,3-dicarbonyl compounds and polymerizable 1,3-diketoamides.

Suitable polyymerizable 1,3-dicarbonyl compounds include acetoacetoxyethyl acrylate, acetoacetoxyethyl methacrylate (AEEM), acetoacetoxypropyl methacrylate, acetoacetoxybutyl methacrylate, 2,3-di(acetoacetoxy)propyl methacrylate and allyl acetoacetate.

Suitable polymerizable 1,3-diketoamides include those compounds described in U.S. Pat. No. 5,889,098, which patent is incorporated herein by reference. Examples of compounds of this type include amido acetoacetonates such as 3-isopropenyl-α,α-dimethylbenzyl amidoacetoacetate, 4-isopropenyl-α,α-dimethylbenzyl amidoacetoacetate, 4-ethylenyl-phenyl amidoacetoacetate and the like.

Preferred unsaturated, multi-functional, carbonyl-containing co-monomers of the foregoing types include, diacetone acrylamide (DiAAA), acetoacetoxyethyl methacrylate (AEEM), acetoacetoxypropyl methacrylate, acetoacetoxybutyl methacrylate, 2,3-di(acetoacetoxy)propyl methacrylate and allyl acetoacetate. Diacetone acrylamide and acetoacetoxyethyl methacrylate are the most preferred.

Typically unsaturated, carbonyl-functional co-monomers of these types can be present in the polymerization mixture in amounts ranging from about 0.1 to 4.0 pphm. More preferably such co-monomers will be present in amounts from about 0.5 to 3.5 pphm.

In some instances when using such carbonyl functional co-monomers, in order to achieve the desired alteration of interpolymer molecular weight, branching and/or flow properties such that a film formed from the interpolymer exhibits an elongation value of less than about 125% at 110° C., it is preferred to also include one or more water-soluble, external cross-linking agents in the emulsion polymerization reaction mixture. Water-soluble external cross-linking agents which can be employed in this manner are those which will react with the carbonyl functionalities of the non-silicon-containing, unsaturated, multifunctional co-monomers which have been polymerized into the interpolymer backbone.

One preferred type of water-soluble cross-linking agent which can be used in the carpet coating compositions herein comprises a compound which contains at least two hydrazine moieties. Particularly suitable are dihydrazine compounds of aliphatic dicarboxylic acids of 2 to 10, in particular 4 to 6, carbon atoms, e.g., oxalic acid dihydrazide, malonic acid dihydrazide, succinic acid dihydrazide, glutaric acid dihydrazide, adipic acid dihydrazide, sebacic acid dihydrazide, maleic acid dihydrazide, fumaric acid dihydrazide and/or itaconic acid dihydrazide. Water-soluble aliphatic dihydrazines of 2 to 4 carbon atoms, e.g., ethylene-1,2-dihydrazine, propylene-1,3-dihydrazine or butylene-1,4-dihydrazine, are also suitable. Adipic acid dihydrazide (ADH) is the most preferred water-soluble cross-linking agent for use in the compositions herein.

The water-soluble cross-linking agent will generally be present in the emulsion polymerization reaction mixture in an amount such that the molar ratio of cross-linking agent hydrazine groups to co-monomer carbonyl groups in the blend is between about 0.1 and about 2.0. More preferably the molar ratio of cross-linking agent hydrazine groups to copolymer carbonyl groups in the blend will be between about 0.5 and 1.5. In order to provide such ratios, the dihydrazine water-soluble cross-linking agent can be present in the polymerization mixture in amounts ranging from about 0.1 to 3.0 pphm, more preferably from about 0.2 to 2.0 pphm.

It may also be desired to optionally incorporate into the interpolymer minor amounts of certain additional co-monomer types which assist in the stabilizing of the latex emulsion which is formed. Such stabilizing co-monomers are those which are ionic in character by virtue of containing acid moieties or the salts or half-esters of such acid moieties.

Such optional ionic monomers preferably are selected from α,β-ethylenically unsaturated $C_3$-$C_8$ monocarboxylic acids, α,β-ethylenically unsaturated $C_4$-$C_8$ dicarboxylic acids and the anhydrides thereof, the $C_4$-$C_8$ alkyl half-esters of the α,β-ethylenically unsaturated $C_4$-$C_8$ dicarboxylic acids, and unsaturated substituted sulfonic acids. Exemplary monomers of this type include acrylamido methyl propane sulfonic acid, styrene sulfonate, sodium vinyl sulfonate, acrylic acid and methacrylic acid, and the $C_4$-$C_8$ alkyl half esters of maleic acid, maleic anhydride, fumaric acid, and itaconic acid.

The foregoing types of optionally present ionic co-monomers, if employed, are added in very low amounts of from 0.1 pphm to 5.0 pphm. More preferably, if used the optional ionic co-monomers will comprise from about 0.2 pphm to 1.0 pphm of the monomer mixture.

The interpolymer comprising the essential and optional co-monomers hereinbefore described can be prepared using conventional emulsion polymerization procedures which result in the preparation of carpet coating compositions used in this invention in aqueous latex form. Such procedures are described, for example, in U.S. Pat. No. 5,849,389, the disclosure of which is incorporated herein by reference in its entirety.

In a typical polymerization procedure, the vinyl ester, ethylene, and other co-monomers can be polymerized in an aqueous medium under pressures not exceeding 100 atmospheres in the presence of a catalyst and at least one emulsifying agent. The aqueous system can be maintained by a suitable buffering agent at a pH of 2 to 6, with the catalyst being added incrementally or continuously. More specifically, vinyl acetate and 50% to 75% of the other co-monomers can be suspended in water and thoroughly agitated in the presence of ethylene under the working pressure to effect solution of the ethylene in the mixture up to the substantial limit of its solubility under the conditions existing in the reaction zone. The vinyl acetate and other-co-monomers can then be gradually heated to polymerization temperature.

The homogenization period is generally followed by a polymerization period during which the catalyst, which consists of a main catalyst or initiator, and may include an activator, is added incrementally or continuously together with the remaining co-monomers. The monomers employed may be added either as pure monomer or as a premixed emulsion.

Suitable as polymerization catalysts include the water-soluble free-radical-formers generally used in emulsion polymerization, such as hydrogen peroxide, sodium persulfate, potassium persulfate and ammonium persulfate, as well as tert-butyl hydroperoxide, in amounts of between 0.01% and 3% by weight, preferably 0.01% and 1% by weight based on the total amount of the emulsion. They can be used together with reducing agents such as sodium formaldehyde-sulfoxylate, ferrous salts, sodium dithionite, sodium hydrogen sulfite, sodium sulfite, sodium thiosulfate, as redox catalysts in amounts of 0.01% to 3% by weight, preferably 0.01% to 1% by weight, based on the total amount of the emulsion. The free-radical-formers can be charged in the aqueous emulsifier solution or be added during the polymerization in doses.

The manner of combining the polymerization ingredients can be by various known monomer feed methods, such as, continuous monomer addition, incremental monomer addition, or addition in a single charge of the entire amounts of monomers. The entire amount of the aqueous medium with polymerization additives can be present in the polymerization vessel before introduction of the monomers, or alternatively, the aqueous medium, or a portion of it, can be added continuously or incrementally during the course of the polymerization.

The emulsion polymerization used to prepare the interpolymer in aqueous latex form is carried out in the presence of a stabilization system which comprises one or more anionic and/or nonionic surfactants as emulsifiers. Such emulsifiers are conventional and well known. Suitable nonionic surfactants which can be used as emulsifiers in the emulsion stabilizing system of the coating compositions herein include polyoxyethylene condensates. A wide variety of nonionic surfactants of this type are disclosed in the hereinbefore-referenced U.S. Pat. No. 5,849,389. Suitable anionic surfactants which can be used as emulsifiers in the emulsion stabilizing system of the coating compositions herein include alkyl aryl sulfonates, alkali metal alkyl sulfates, sulfonated alkyl esters and fatty acid soaps. A wide variety of anionic surfactants of this type are also disclosed in the hereinbefore-referenced U.S. Pat. No. 5,849,389.

Conventionally, various protective colloids have been used to stabilize vinyl ester/ethylene emulsion polymer latex compositions of the type hereinbefore described, instead of or in addition to the surfactant emulsifiers. It has been discovered, however, that to realize especially useful compatibility and processing benefits, the coating compositions of the present inventions should be kept substantially free of such protective colloids as polyvinyl alcohol (PVOH) and other conventional protective colloid-forming materials.

While some very small amounts of protective colloid materials can be tolerated, and may in fact be useful processing the binder emulsion component of the coating compositions used herein, the binder emulsions herein should contain no more than about 1.0 pphm and preferably no more than about 0.5 pphm of protective colloid materials, and even as low as 0.2 pphm. Binder emulsions using surfactant-based stabilizing systems and containing no more than these amounts of protective colloid-forming materials are considered for purposes of this invention to be "substantially free" of protective colloid materials. The latex emulsions which utilize such stabilizing systems are also those characterized herein as being "substantially all-surfactant-based" emulsions.

Following polymerization, the solids content of the resulting aqueous polymer emulsion binder can be adjusted to the level desired by the addition of water or by the removal of water by distillation. Generally, the desired level of polymeric solids content is from about 40 weight percent to about 70 weight percent based on the total weight of the emulsion, more preferably from about 50 weight percent to about 60 weight percent.

If desired, conventional additives may be incorporated into the carpet coating compositions used herein in order to modify the properties thereof. Among these additives may be included fillers, thickeners, catalysts, dispersants, colorants, biocides, anti-foaming agents, etc.

In particular, the ability to load the coating with high amounts of fillers such as clay, calcium carbonate, aluminum trihydrate, barium, feldspar, etc., permits an increase in the superior flame retardency and low smoke properties the copolymer already has. Preferred coating compositions in accordance with the present invention are loaded with filler to yield a composition comprising from about 10 to about 50 weight percent interpolymer, and from about 50 to about 90 weight percent filler, based on total weight of the composition, depending in part on the type and form of the carpet being constructed.

Prior to drying, the carpet coating compositions herein can generally have a total solids content ranging from about 50 wt % to 95 wt %. More preferably, prior to drying, the coating compositions herein will have a total solids content ranging from about 80 wt % to 90 wt %.

EXAMPLES

The carpet coating compositions used to prepare the improved carpet products of the present invention are illustrated by the following Examples. A number of different carpet binder emulsions, and carpet coating compositions made therefrom, are prepared and tested. Some of these binders and compositions utilize all of the elements of the binders and coating compositions as described in the claims herein. Others of these binders and compositions do not utilize all of the claim elements and are thus comparative.

Test Methods.

The test methods used to evaluate the several carpet coating compositions which are prepared as described in these examples are carried out as follows:

Film Elongation Test

This test evaluates the characteristics of neat films which are prepared by drying the binder latex emulsions that form the basis of carpet coating compositions of the type used in the improved carpet products herein. This test was developed as a way to simulate the processing issues which have been experienced in the past with, for example, VAE emulsion polymers, especially those which are partially or mostly surfactant stabilized.

Carpet coated with compositions used as a precoat or skip coat typically exits the drying ovens at 110-120° C. and then travels over a series of guide rollers and possibly through a shearing machine. As indicated above, if the latex binder of the coating composition will flow under heat, it can then transfer to these processing rollers and create build-up which can cause maintenance issues. In addition, at times this build-up can transfer back to the carpet which can cause gouges in the face of the carpet as it goes through the shearing machine.

The Film Elongation Test involves drying emulsion polymer latex compositions into films having a thickness of from about 0.045-0.055 inches and having an overall length of 3 inches. The films are then marked to show 2 inches. A 50 gram weight is attached to the bottom of the film, and a clamp is attached to the top of the film to allow the film to be hung in an oven. After hanging in the oven for 20 minutes at the desired test temperature, including both 70° C. and 110° C., the original 2 inch width (W1) is remeasured to determine its new width (W2).

The % elongation is then calculated as follows:

$$\% \text{ Elongation at High Temperature} = (W2 - W1)/W1 \times 100.$$

Binders which exhibit lower elongation values can be used to form coating compositions which can be run in the carpet manufacturing process with few or no problems relating to coating build-up and transfer-back to and from processing rollers.

SBR Compatibility Test

The several binder emulsions prepared herein are tested for their compatibility with a styrene-butadiene emulsion in the SBR compatibility test. Viscosity of the binder emulsion as made is measured. Each emulsion is then blended at a 2:1 weight ratio with a styrene-butadiene polymer emulsion of the type which can be used to form SBR coatings of a grade typically utilized in the carpet industry. The viscosity of the blend of the two types of emulsions is then measured. A Compatibility Rating for each blend is then determined based on the percentage change in viscosity observed. This Compatibility Rating scale is given as:

Poor=>200% Increase in viscosity or occurance of coagulation;

Fair=Viscosity increases between 50% and 200%;

Good=Viscosity increases between 0% and 50%;

Excellent=No viscosity increase or viscosity reduction.

Tuft Bind Testing

Once the binder emulsions described herein are formulated into coating compositions, several tests can be used to determine the effectiveness of such coating compositions. When a coating composition herein is to be used as a precoat to lock tufts into a primary backing substrate, a Tuft Bind test can be used to evaluate the effectiveness of the composition as a precoat. This test measures the amount of force (in lbs) that is required to pull a tuft through the primary tufting substrate. Testing is done similar to ASTM D1335-05 but with certain minor changes. Individual tufts are hooked with a metal device, and this device is placed in top jaw of an Instron apparatus. The carpet is then attached to the bottom jaw of the Instron. The jaws are separated at a rate of 12 inches per minute. Approximately 6-7 tufts are pulled for each carpet sample, and the values from each pull recorded by the Instron are averaged. Results are reported in lbs force.

Delamination Testing

When a coating composition herein is to be used as a skip coat or adhesive coating to attach a scrim as a secondary backing to the back of precoated carpet, a Delamination test can be used to evaluate the effectiveness of the composition as the skip coat or adhesive coating. This test measures the adhesive strength property of the carpet coating in securing the polypropylene secondary backing by testing the force required to separate the coated carpet from the polypropylene secondary backing. This test is done similar to ASTM D 3936-05 but with some slight modifications. The major difference in the test is that the average force in lbs recorded by an Instron is used rather than selecting the best six peaks over a 3 inch area of the curve. The clamps of the Instron are then separated at a rate of 12 inches per minute, and the average force required to separate the polypropylene secondary backing from the coated carpet is measured and recorded. The results are reported in pounds per inch.

Binder Emulsion Preparation

A number of binder emulsions based on vinyl acetate/ethylene (VAE) interpolymers are prepared using the general polymerization techniques described in Comparative Example 1 and in Examples 1-4 of U.S. Pat. No. 5,576,384, incorporated herein by reference. The interpolymers in the emulsions made may contain relatively small amounts of additional co-monomers including some of the ionic emulsion stabilizing co-monomers and/or some of the unsaturated silane co-monomers used in the present invention to modify the film elongation properties of films made from the emulsions containing these VAE-based interpolymers. All of the binder emulsions made are emulsified with various amounts of anionic and/or nonionic emulsifiers. Some of the binder emulsions made also contain varying amounts of protective colloids based on polyvinyl alcohol (PVOH) or hydroxyethyl cellulose.

The components of each of the various binder emulsions as made are described in Table 1. A commercially available styrene-butadiene SBR rubber forming emulsion is also included in the Table 1 examples.

TABLE 1

BINDER EMULSIONS

| Example No. | Type | Main Monomers | Functional Monomers | Surfactants | Colloid |
|---|---|---|---|---|---|
| 1 | VAE | 89.6VA/10.4E | SVS-0.5 | Nonionic-2.4 | PVOH-2.5 |
| 2 | VAE | 85.4VA/14.6E | None | Nonionic-2.4 | PVOH-2.5 |
| 3 | VAE | 85.8VA/14.2E | None | Nonionic-0.4 | PVOH-4.0 |
| 4 | VAE* | 91.2VA/8.8E | SVS-0.2<br>VTMOsilane-0.4 | Anionic-0.5<br>Nonionic-3 | PVOH-0.5 |
| 5 | VAE | 83.5VA/12.5E/4.0BA | SVS-0.1 | A&N Surfactant Combination-4.2 | HEC-0.5 |
| 6 | VAE | 87.8VA/12.2E | SVS-0.5 | A&N Surfactant Combination-3.3 | None |
| 7 | VAE* | 91VA/9E | SVS-0.2<br>VTMOsilane-0.4 | Anionic-3.0 | PVOH-0.5 |
| 8 | VAE* | 91.2VA/8.8E | SVS-0.2<br>VTMOsilane-0.4 | Anionic-0.5<br>Nonionic-3 | PVOH-0.5 |
| 9 | VAE | 87.8VA/12.2E | SVS-1.0 | Anionic-0.45<br>Nonionic-3 | None |
| 10 | VAE | 87.8VA/12.2E | SVS-1.0<br>VTMOsilane-0.5 | Anionic-1.5<br>Nonionic-0.5 | None |
| 11 | VAE | 86.9VA/13.1E | SVS-0.5<br>VTMOsilane-0.5 | Anionic-0.45<br>Nonionic-2.9 | PVOH-0.2 |

TABLE 1-continued

BINDER EMULSIONS

| Example No. | Type | Main Monomers | Functional Monomers | Surfactants | Colloid |
|---|---|---|---|---|---|
| 12 | VAE | 86.9VA/13.1E | SVS-0.5<br>VTMOsilane-0.5<br>AA-1.0 | Anionic-0.45<br>Nonionic-2.9 | PVOH-0.2 |
| 13 | SBR | Styrene/Butadiene | — | — | — |

In Table 1, the following designations are used:
VA is vinyl acetate, E is ethylene and BA is butyl acrylate.
VAE represents a vinyl acetate/ethylene binder emulsion.
VTMOsilane is vinyl trimethoxy silane.
SVS is sodium vinyl sulfonate and AA is acrylic acid.
PVOH is polyvinyl alcohol and HEC is hydroxyethyl cellulose.
SBR is styrene-butadiene rubber.
Numerical values are parts per hundred based on total of VA and E co-monomers.
The * denotes heterogeneous VAE emulsions made using two-stage polymerization such as disclosed in U.S. Pat. No. 7,078,455.

Films formed from the several binder emulsions described in Table 1 are evaluated for their film elongation properties in accordance with the Film Elongation Test hereinbefore described. Results of the Film Elongation Testing at 110° C. are shown in Table 2.

TABLE 2

FILM ELONGATION VALUES

| Example No. | Type | Silane? | High or Low Surfactant | Colloid Free? | % Elongation at 110° C. |
|---|---|---|---|---|---|
| 1 | VAE | No | High | No | 300% |
| 2 | VAE | No | High | No | 115.63% |
| 3 | VAE | No | Low | No | 12.5% |
| 4 | VAE | Yes | High | Yes-Minimal | 31.25% |
| 5 | VAE | No | High | Yes-Minimal | >300% |
| 6 | VAE | No | High | Yes-None | N/A >300% @ 70° C. |
| 7 | VAE | Yes | High | Yes-Minimal | 25% |
| 8 | VAE | Yes | High | Yes-Minimal | 88% |
| 9 | VAE | No | High | Yes-None | >300% |
| 10 | VAE | Yes | High | Yes-None | 12.5% |
| 11 | VAE | Yes | High | Yes-Minimal | 63% |
| 12 | VAE | Yes | High | Yes-Minimal | 24% |
| 13 | SBR | No | N/A | N/A | 12.5% |

The several binder emulsions described in Table 1 are also evaluated for their potential compatibility with styrene-butadiene rubber (SBR) substrates in accordance with the SBR Compatibility Test hereinbefore described. Results of the SBR Compatibility testing are shown in Table 3.

TABLE 3

SBR COMPATIBILITY

| Example No. | Initial Binder Viscosity (cps) Brookfield Viscometer at 20 rpm | Viscosity of 2:1 Blend with SB (cps) Brookfield Viscometer at 20 rpm | % Viscosity Increase | Compatibility Rating |
|---|---|---|---|---|
| 1 | 1000 | 2100 | 110% | Fair |
| 2 | 1300 | 2000 | 53.8% | Fair |
| 3 | 900 | coagulated | N/A | Poor |
| 4 | 1350 | 840 | −37.0% | Good |
| 5 | 950 | 475 | −50.0 | Excellent |
| 6 | 250 | 250 | 0.0% | Excellent |
| 7 | 800 | 550 | −31.3% | Excellent |
| 8 | 1900 | 1000 | −47.4% | Excellent |
| 9 | 350 | 300 | −14.3% | Excellent |

TABLE 3-continued

SBR COMPATIBILITY

| Example No. | Initial Binder Viscosity (cps) Brookfield Viscometer at 20 rpm | Viscosity of 2:1 Blend with SB (cps) Brookfield Viscometer at 20 rpm | % Viscosity Increase | Compatibility Rating |
|---|---|---|---|---|
| 10 | N/A | N/A | N/A | N/A |
| 11 | 725 | 625 | −13.8% | Excellent |
| 12 | 675 | 600 | −11.1% | Excellent |

Precoat Formulations

Certain of the binder emulsion formulations hereinbefore described are formulated into precoat compositions suitable for application to a tuft-containing primary carpet backing. Such precoat formulations have the following composition:

PRECOAT

| Ingredients | Pts by Wt (Dry) | Pts by Wt (Wet) |
|---|---|---|
| Binder at 55% Solids | 100.0 | 181.8 |
| Water | 0.0 | 36.6 |
| Polyacrylate Dispersant | 0.5 | 2.0 |
| Calcium Carbonate | 500.0 | 500.0 |
| Froth Aid (SLS) | 1.8 | 6.0 |
| Thickener | as needed for 9000-10,000 visc (Brookfield at 20 rpm) | |

Total Composition Solids = 82.9%
SLS = sodium lauryl sulfate is a surfactant used to help froth the composition.

Such a precoat composition is applied to a carpet which employs polypropylene face yarns which are tufted into a woven polypropylene primary tufting substrate. The basis weight of this resulting carpet ranges from 23.75 to 24.25 oz per sq yard. The precoat composition is frothed and then coated onto the back of the carpet. Target dry add-on weights are in the range of 26-28 oz per sq yard.

Several carpet samples having precoat compositions added thereto are tested for tuft binding in accordance with the Tuft Binding test hereinbefore described. The precoated compositions used to make the carpet samples tested are those made with the binder emulsions of Example Nos 1, 11, 12 and 13 from Table 1. A carpet sample with a precoat made from a binder emulsion of the SBR type is also tested. Results of the Tuft Binding test are shown in Table 4.

TABLE 4

| TUFT BINDING BY PRECOAT | |
|---|---|
| Carpet Made With Precoat Prepared From Binder Emulsion Example No. | Tuft Binding (Lbs) |
| 1 | 9 |
| 10 | 8.5 |
| 11 | 9.1 |
| 12 | 9.5 |
| 13 (SBR) | 10.8 |

Skip Coat Formulations

Certain of the binder emulsion formulations hereinbefore described are also formulated into skip coat compositions suitable for attaching a scrim to the back of a carpet substrate. Such skip coat compositions are applied to the scrim, and the scrim is then applied to the back of the carpet before going into an oven. The purpose of the skip coat or adhesive coating is to provide a layer of composition or adhesive which will adhere the woven scrim to the back of the carpet. The skip coat composition is usually lower in filler loading than the precoat compound and higher in viscosity. The viscosity will be dependant upon the type of applicator system being utilized for the skip coat. A typical skip coat formulation using binders such as those described in Table 1 is set forth as follows:

| SKIP COAT | | |
|---|---|---|
| Ingredients | Pts by Wt (Dry) | Pts by Wt (Wet) |
| Binder at 55% Solids | 100.0 | 181.8 |
| Water | 0.0 | 16.8 |
| Polyacrylate Dispersant | 0.5 | 2.0 |
| Calcium Carbonate | 400.0 | 400.0 |
| Optional Froth Aid (SLS) | 1.8 | 6.0 |
| Thickener | As needed for 14,000-15,000 visc (Brookfield at 20 rpm) | |

Total Composition Solids = 82.8%

The secondary scrim backing material which is attached to the carpet using the skip coat is typically made of polypropylene. This material can be an open weave construction with the size of the openings in the range of ⅛ inches×3/16 inches. The scrim weights are typically in the range of 0.7 to 1.1 oz per sq yd.

The skip coat composition can also be frothed in order to achieve the needed weights but may not need to be frothed. Target add-on weights are in the range of 4-6 oz per square yd. The skip coat composition is applied to the polypropylene scrim, and then the scrim is married to the back of the carpet which is still wet with the precoat composition. The carpet and scrim are then dried in an oven at 130° C. for 8 minutes.

Several carpet samples having polypropylene scrims attached by means of a skip coat are tested for delamination force in accordance with the Delamination test hereinbefore described. The skip coat compositions used to make the carpet samples tested are those made with the binder emulsions of Example Nos 1, 11, 12 and 13 from Table 1. A carpet sample with a skip coat made from a binder emulsion of the SBR type is also tested. Results of the Delamination testing are shown in Table 5.

TABLE 5

| DELAMINATION OF SKIP COAT ATTACHED SCRIM | |
|---|---|
| Carpet Made With Skip Coat Prepared From Binder Emulsion Example No. | Delamination Values (Lbs per Inch) |
| 1 | 0.5 |
| 10 | 0.9 |
| 11 | 0.9 |
| 12 | 1.1 |
| 13 (SBR) | 2 |

A number of additional VAE binder emulsions are prepared in a similar manner to those described in Examples 1 to 12 above using a variety of different vinyl alkoxy silanes in combination with acrylic acid as co-monomers. Films formed from these emulsion binder formulations are tested in the manner described above for their high temperature elongation values for 20 minutes at 110° C.

These same binder emulsions are then used to form both pre-coat compositions and skip coat compositions, again in a manner similar to that described above for pre-coat and skip coast preparation. These pre-coat and skip coat compositions are thereafter used to make carpet products, again in a manner similar to that hereinbefore described. The pre-coat and skip coat compositions are applied at add-on levels of 22 oz/yd$^2$ and 8 oz/yd$^2$, respectively. Carpet products with the pre-coat applied are then tested for their tuft binding performance in the manner described above, and carpet products with the skip coat used to attach a polypropylene scrim are tested for their delamination values, also in general accordance with the procedures outlined above.

The binder emulsions so prepared, the high temperature elongation values for films made therefrom and the Tuft Binding and Delamination Values for carpet products made therefrom are all set forth hereinafter in Table 6.

TABLE 6

| SILANE BINDER EMULSIONS AND CARPETS | | | | | |
|---|---|---|---|---|---|
| Example No. | Main Monomers | Functional Monomers | % Elongation at 110° C. | Tuft Bindiing (Lbs) | Delam Value (Lbs/in) |
| 14 | 87VA/13E | VTEO silane-1.5 AA-3 | 12.5% | 6.1 | 2.5 |
| 15 | 87VA/13E | VTEO silane-1.5 AA-3 | 12.5% | 6.9 | 3 |
| 16 | 89.5VA/10.5E | VTEO silane-1 AA-2 | 12.5% | N/A | N/A |
| 17 | 87VA/13E | VTMO silane-1.17 AA-1 | 6.3% | 6.6 | 2.8 |
| 18 | 92VA/8E | VTMO silane-1.17 AA-3 | 6.3% | 6.3 | 3.2 |
| 19 | 89.5VA/10.5E | VTMO silane-0.78 AA-2 | 6.3% | 6.8 | 2.5 |

TABLE 6-continued

SILANE BINDER EMULSIONS AND CARPETS

| Example No. | Main Monomers | Functional Monomers | % Elongation at 110° C. | Tuft Bindiing (Lbs) | Delam Value (Lbs/in) |
|---|---|---|---|---|---|
| 20 | 92VA/8E | VTEO silane-1.5<br>AA-1 | 12.5% | 6.7 | 2.1 |
| 21 | 89.5VA/10.5E | VTEO silane-1.0<br>AA-2 | 25.0% | 6.7 | 3.3 |
| 22 | 92VA/8E | VTMO silane-0.39<br>AA-1 | 25.0% | 7.9 | 2.2 |
| 23 | 89.5VA/10.5E | VTMO silane-0.78<br>AA-2 | 0.0% | 6.3 | 4.0 |
| 24 | 92VA/9E | VTEO silane-0.5<br>AA-3 | 31.5% | 5.5 | 4.0 |
| 25 | 87VA/13E | VTMO silane-0.5<br>AA-1 | 12.5% | 7.5 | 4.1 |

In Table 6, the following designations are used:
VA is vinyl acetate and E is ethylene
VTMO silane is vinyl trimethoxy silane.
VTEO silane is vinyl triethoxy silane.
AA is acrylic acid
N/A—Carpet not prepared. Emulsion was dilatent.
Numerical values for monomers are parts per hundred based on total of VA and E co-monomers.

Still other VAE binder emulsions are prepared in similar manner to those described above using, instead of vinyl alkoxy silanes co-monomers, various combinations of a diacetone acrylamide DiAAA) co-monomer with an adipic acid hydrazide (ADH) cross-linking agent. The emulsion binders prepared also contain either acrylic acid or monooctyl maleate as stabilizing ionic co-monomers.

Again films formed from these DiAAA/ADH emulsion binder formulations are tested in the general manner described above for their high temperature elongation values for 20 minute at 110° C. These same binder emulsions are then used to form both pre-coat compositions and skip coat compositions, again in a manner similar to that described above. These pre-coat and skip coat compositions are thereafter used to make carpet products, again in a manner familiar to that hereinbefore described. The pre-coat and skip coat compositions are applied at add-on levels of 22 oz/yd$^2$ and 8 oz/yd$^2$, respectively.

Carpet products with the pre-coat applied are then tested for their tuft binding performance in the general manner described above and carpet products with the skip coat used to attach a polypropylene scrim are tested for their delamination values in accordance with ASTM D 3936-05 procedures. The DiAAA/ADH binder emulsions so prepared, the high temperature elongation values for films made therefrom and the Tuft Binding and Delamination Values for carpet products made therefrom are all set forth hereinafter in Table 7.

TABLE 7

DiAAA/ADH BINDER EMULSIONS AND CARPETS

| Example No. | Main Monomers | Functional Monomers & Cross-Linkers | % Elongation at 110° C. | Tuft Bindiing (Lbs) | Delam Value (Lbs/in) |
|---|---|---|---|---|---|
| 26 | 87VA/13E | DiAAA-3<br>ADH-1.5<br>AA-1 | 13% | 6.9 | 3.5 |
| 27 | 87VA/13E | DiAAA-1<br>ADH-0.5<br>AA-1 | 50% | 7 | 3.3 |

TABLE 7-continued

DiAAA/ADH BINDER EMULSIONS AND CARPETS

| Example No. | Main Monomers | Functional Monomers & Cross-Linkers | % Elongation at 110° C. | Tuft Bindiing (Lbs) | Delam Value (Lbs/in) |
|---|---|---|---|---|---|
| 28 | 87VA/13E | DiAAA-3<br>ADH-1.5<br>AA-2 | 13% | 6.9 | 3.2 |
| 29 | 87VA/13E | DiAAA-2<br>ADH-1<br>AA-1.5 | 63% | 7.1 | 3.1 |
| 30 | 87VA/13E | DiAAA-2<br>ADH-1<br>AA-1.5 | 38% | 6.8 | 3 |
| 31 | 87VA/13E | DiAAA-1<br>ADH-0.5<br>AA-2 | 225% | 698 | 3.2 |
| 32 | 87VA/13E | DiAAA-2<br>ADH-1<br>MOM-4.75 | 88% | 6.9 | 3 |

In Table 7, the following designations are used:
VA is vinyl acetate and E is ethylene
DiAAA is diacetone acrylamide.
ADH is adipic acid dihydrazide.
AA is acrylic acid
MOM is monooctyl maleate
Numerical values for monomers/cross-linkers are parts per hundred based on total of VA and E co-monomers.

What is claimed is:

1. A carpet product which employs a coating composition to secure carpet fibers to a carpet backing or substrate and/or to secure one or more carpet scrims or other layers to carpet backing, wherein said carpet coating composition comprises:

A) an interpolymer present in an amount effective to function as a binder in the carpet coating composition, said interpolymer being prepared by the emulsion polymerization of:

i) one or more vinyl ester monomers;

ii) ethylene; and iii) from about 0.1 to 0.78 pphm of an unsaturated silane co-monomer, wherein a film formed from said interpolymer exhibits an elongation value of less than about 125% at 110° C.;

B) water; and

C) a stabilizing system which comprises one or more anionic and/or nonionic surfactants but which is substantially free of any protective colloid material, said stabilizing system being present in an amount which is effective to disperse the interpolymer in the water.

2. The carpet product according to claim 1 wherein the interpolymer of the coating composition used in the carpet further comprises from about 0.1 pphm to 5 pphm of one or more emulsion-stabilizing ionic co-monomers.

3. The carpet product according to claim 2 wherein the emulsion-stabilizing ionic co-monomer is selected from the group consisting of acrylamido methyl propane sulfonic acid, styrene sulfonate, sodium vinyl sulfonate, acrylic acid and methacrylic acid, and the $C_4$ -$C_8$ alkyl half esters of maleic acid, maleic anhydride, fumaric acid, and itaconic acid.

4. The carpet product according to claim 1 wherein a film formed from said interpolymer exhibits an elongation value of from about 5% to 50% at 110° C.

5. The carpet product according to claim 1 wherein the vinyl ester monomer used to prepare the interpolymer component of the carpet coating composition used in the carpet is vinyl acetate and the unsaturated silane co-monomer is a vinyl trialkoxy silane.

6. The carpet product according to claim 5 wherein the unsaturated silane co-monomer used to prepare the interpolymer component of the carpet coating composition used in the carpet is selected from the group consisting of vinyltrimethoxysilane, vinyltriethoxysilane, ω-methacryloxypropyltrimethoxysilane, vinyl tris(2-methoxyethoxy)silane, vinyltriisopropoxy silane, vinylpropyltriisopropoxy silane, vinylpropyltriisobutoxy silane, vinyltriisobutoxy silane, vinylpentyltri-t-butoxy silane, vinylpropylmethyldipentoxy silane, and vinylpropyltri-sec-butoxy silane.

7. The carpet product according to claim 1 wherein the stabilizing system of the coating composition used in the carpet comprises nonionic surfactants which are polyoxyethylene condensates.

8. The carpet product according to claim 1 wherein the stabilizing system of the coating composition used in the carpet comprises anionic surfactants selected from the group consisting of alkyl aryl sulfonates, alkali metal alkyl sulfates, sulfonated alkyl esters and fatty acid soaps.

9. The carpet product according to claim 1 wherein the interpolymer component of the coating composition used in the carpet is prepared by emulsion polymerizing i) from about 67.0 to 94.9 pphm of the vinyl ester monomer;

ii) from about 1.0 to 30.0 pphm of ethylene; and iii) from about 0.1 to 0.78 pphm of the unsaturated silane co-monomer.

10. The carpet product according to claim 1 wherein the carpet coating composition used in the carpet further contains from about 50 wt % to 90 wt % of filler material selected from the group consisting of calcium carbonate, clay, aluminum trihydrate, barite, feldspar, cullet, flyash and recycled carpet backing.

11. The carpet product according to claim 1 wherein the carpet coating composition used in the carpet has a total solids content of from about 50% to 95% by weight prior to drying.

12. The carpet product according to claim 1, wherein the amount of surfactants is from 2.0 to 3.5 pphm.

13. The carpet product according to claim 1, wherein the amount of protective colloid is from 0.2 to 1.0 pphm.

14. A carpet product which employs a coating composition to secure carpet fibers to a carpet backing or substrate and/or to secure one or more carpet scrims or other layers to carpet backing, wherein the carpet coating composition comprises:

A) an interpolymer present in an amount effective to function as a binder in the carpet coating composition, wherein said interpolymer is prepared by the emulsion polymerization of:

i) from about 67.0 to 94.9 pphm of vinyl acetate monomer;

ii) from about 1.0 to 30.0 pphm of ethylene; and iii) from about 0.1 to 0.78 pphm of a vinyl trialkoxy silane co-monomer, such that a film formed from said interpolymer exhibits an elongation value of less than about 125% at 110° C.;

B) water; and

C) a stabilizing system which comprises one or more anionic and/or nonionic surfactants but which is substantially free of any protective colloid material, said stabilizing system being present in an amount which is effective to disperse the interpolymer in the water.

15. The carpet product according to claim 14 wherein the coating composition used in the carpet further comprises from about 0.1 pphm to 5.0 pphm of one or more emulsion-stabilizing ionic co-monomers selected from the group consisting of acrylamido methyl propane sulfonic acid, styrene sulfonate, sodium vinyl sulfonate, acrylic acid and methacrylic acid, and the $C_4$-$C_8$ alkyl half esters of maleic acid, maleic anhydride, fumaric acid, and itaconic acid.

16. The carpet product according to claim 14 wherein the vinyl trialkoxy silane co-monomer used to prepare the interpolymer component of the carpet coating composition used in the carpet is selected from the group consisting of vinyltrimethoxysilane, vinyltriethoxysilane, ω-methacryloxypropyltrimethoxysilane, vinyl tris(2-methoxyethoxy)silane, vinyltriisopropoxy silane, vinylpropyltriisopropoxy silane, vinylpropyltriisobutoxy silane, vinyltriisobutoxy silane, vinylpentyltri-t-butoxy silane, vinylpropylmethyldipentoxy silane, and vinylpropyltri-sec-butoxy silane.

17. The carpet product according to claim 14 wherein the carpet coating composition used in the carpet further contains from about 50 wt % to 90 wt % of filler material selected from the group consisting of calcium carbonate, clay, aluminum trihydrate, barite, feldspar, cullet, flyash and recycled carpet backing.

18. The carpet product according to claim 14, wherein the amount of surfactants is from 2.0 to 3.5 pphm.

19. The carpet product according to claim 14, wherein the amount of protective colloid is from 0.2 to 1.0 pphm.

* * * * *